US006606062B2

(12) United States Patent
Ngounou Kouam et al.

(10) Patent No.: US 6,606,062 B2
(45) Date of Patent: Aug. 12, 2003

(54) PLANAR ANTENNA AND A DUAL BAND TRANSMISSION DEVICE INCLUDING IT

(75) Inventors: Charles Ngounou Kouam, deceased, late of Les Ulis (FR), by Anduú D. Ngounou Yossa legal representative; Jean-Philippe Coupez, Le Relecq Kerhuon (FR)

(73) Assignee: Alcatel, Paris (FR)

( * ) Notice: Subject to any disclaimer, the term of this patent is extended or adjusted under 35 U.S.C. 154(b) by 0 days.

(21) Appl. No.: 10/035,114

(22) Filed: Jan. 4, 2002

(65) Prior Publication Data

US 2002/0196191 A1 Dec. 26, 2002

(30) Foreign Application Priority Data

Jan. 5, 2001 (FR) ..... 01 00139

(51) Int. Cl.[7] ..... H01Q 1/38
(52) U.S. Cl. ..... 343/700 MS; 343/846
(58) Field of Search ..... 343/700 MS, 767, 343/829, 830, 846; H01Q 1/38

(56) References Cited

U.S. PATENT DOCUMENTS 4,684,952 A * 8/1987 Munson et al. ..... 343/700 MS
4,972,196 A 11/1990 Mayes et al.
5,617,103 A * 4/1997 Koscica et al. ..... 343/700 MS
6,002,367 A 12/1999 Engblom et al.
6,097,345 A * 8/2000 Walton ..... 343/769
6,421,018 B1 * 7/2002 Zeilinger et al. ..... 343/713
6,466,170 B2 * 10/2002 Zhou ..... 343/700 MS

FOREIGN PATENT DOCUMENTS

EP 0961344 A1 12/1999
WO WO 9702623 1/1997

* cited by examiner

*Primary Examiner*—Tho G. Phan
(74) *Attorney, Agent, or Firm*—Sughrue Mion, PLLC

(57) ABSTRACT

A dual band transmission device includes a microstrip antenna. Its patch is provided with a short circuit for setting up quarter-wave resonant modes. A slot penetrates into the patch from its periphery, in the vicinity of the short circuit, and separates a first region from a second region, which second region nevertheless remains connected to the first region by a passage. Two resonant modes are obtained, one in the first region and the other in the first region, the passage and the second region. They can be excited from a common connecting line. According to the invention, the center frequencies and the pass-bands of the two modes are adjusted by means of a reactive component such as a capacitor which couples the first region to the second region in the vicinity of the origin of the slot. The invention applies in particular to producing a dual mode mobile telephone system conforming to the GSM and DCS standards.

19 Claims, 2 Drawing Sheets

PLANAR ANTENNA AND A DUAL BAND TRANSMISSION DEVICE INCLUDING IT

CROSS-REFERENCE TO RELATED APPLICATIONS

This application is based on French Patent Application No. 01 00 139 filed Jan. 5, 2001, the disclosure of which is hereby incorporated by reference thereto in its entirety, and the priority of which is hereby claimed under 35 U.S.C. §119.

BACKGROUND OF THE INVENTION

1. Field of the Invention

The present invention relates generally to radio transmitter devices, in particular to mobile telephones, and more particularly to microstrip antennas included in such devices.

2. Description of the Prior Art

A microstrip antenna includes a patch that is typically obtained by etching a metal layer. This kind of antenna is known as a microstrip patch antenna.

The microstrip technique is a planar technique that has applications in producing lines and antennas providing coupling between lines transmitting signals and radiated waves. It uses conductive strips and/or patches formed on the top surface of a thin dielectric substrate. A conductive layer on the bottom surface of the substrate constitutes a ground of the line and the antenna. The patch is typically wider than the strip and its shape and dimensions constitute important characteristics of the antenna. The shape of the substrates is typically that of a rectangular plane sheet of constant thickness, and the patch is also typically rectangular. However, varying the thickness of the substrate can widen the pass-band of the antenna and its patch can be various shapes, for example circular. The electric field lines between the strip or the patch and the ground layer pass through the substrate.

Antennas constructed in accordance with these techniques typically, although not necessarily, constitute resonant structures adapted to support standing waves providing a coupling with waves radiated into space.

Various types of resonant structure can be produced using the microstrip technique and can support various resonant modes, which for succinctness are referred to hereinafter as "resonances". Broadly speaking, each resonance can be described as consisting of a standing wave formed by the superposition of two travelling waves propagating in two opposite directions along the same path, these two waves resulting from the alternating reflection of the same travelling electromagnetic wave at the two ends of that path. Using this mode of description, the latter wave propagates in an electromagnetic line consisting of the ground, the substrate and the patch and which defines a linear path of zero width. In fact this kind of wave has wave surfaces that extend transversely over the whole of the section that is offered to them by the antenna, and thus this mode of description simplifies the real life situation, to a degree that is sometimes excessive. To the extent that it can be considered to be linear, the path can be rectilinear or curved. It will be referred to hereinafter as a "resonance path". The frequency of the resonance is inversely proportional to the time taken by the progressive wave referred to above to travel the length of that path.

A first type of resonance might be called "half-wave" resonance. In this type of resonance the length of the resonance path is typically substantially equal to one half-wavelength, i.e. to half the wavelength of the travelling wave referred to above. The antenna is then referred to as a "half-wave" antenna. This type of resonance can be generally defined by the presence of an electrical current node at each of the two ends of the path, whose length can therefore be equal to said half-wavelength multiplied by an integer other than 1. That integer is typically an odd number. Coupling with radiated waves is obtained at one end of the path at least, the ends of the path being situated in regions in which the electric field in the substrate has a maximum amplitude.

A second type of resonance that can be obtained using the same technique might be referred to as a "quarter-wave" resonance. It differs from a half-wave resonance, firstly, in that the resonance path typically has a length substantially equal to one quarter-wavelength, i.e. one quarter of the wavelength defined above. To this end the resonant structure must include a short circuit at one end of the path, the term "short circuit" referring to a connection between the patch and ground. Also, the short circuit must have an impedance that is sufficiently low to impose such resonance. This type of resonance can be generally defined by the presence of an electrical field node fixed by this kind of short circuit in the vicinity of an edge of the patch and by an electrical current node situated at the other end of the resonance path. The length of the resonance path can therefore also be equal to said quarter-wavelength plus an integer number of half-wavelengths. Coupling with the waves radiated into space is obtained at an edge of the patch in a region in which the electric field through the substrate has a sufficiently large amplitude.

Resonances of other, more or less complex, types can be obtained in antennas of this kind, each resonance being characterized by a distribution of the electric and magnetic fields that oscillate in an region of space including the antenna and its immediate vicinity. They depend in particular on the configuration of the patches, which can in particular incorporate slots, possibly radiating slots. They also depend on the presence and location of any short circuits and on electrical models representing the short circuits if they are imperfect, i.e. if they cannot be regarded, even approximately, as perfect short circuits of zero impedance.

The present invention finds an application in diverse types of devices, such as mobile telephones, base stations for mobile telephones, automobile vehicles, aircraft and missiles. In the case of a mobile telephone, the continuous nature of the bottom ground layer of a microstrip antenna limits the radiation that is intercepted by the body of the user of the device when it is transmitting. In the case of automotive vehicles, and above all in the case of aircraft or missiles whose external surface is made of metal and has a curved profile to achieve low aerodynamic drag, the antenna can be conformed to the profile so as not to cause any troublesome additional aerodynamic drag.

The present invention relates more particularly to the situation in which a microstrip antenna must have the following qualities:

it must be a dual frequency antenna, i.e. it must be able to transmit and/or receive efficiently radiated waves on two frequencies separated by a large spectral gap, p1 it must be possible to connect it to a signal processor unit by means of a single connecting line for all operating frequencies of a transmitter device without giving rise to a troublesome spurious standing wave ratio on that line, and it must not be necessary to use a frequency multiplexer or demultiplexer to achieve this result.

Many prior art microstrip antennas that have the above three qualities have been produced or proposed. They differ in terms of the means employed to obtain a plurality of resonant frequencies. Three such antennas will be examined:

A first prior art antenna of the above kind is described in U.S. Pat. No. 4,766,440 (Gegan). The patch 10 of this antenna is generally rectangular in shape and the antenna has two half-wave resonances with resonance paths along a length and a width of the patch. It also includes a U-shaped curved slot which is entirely inside the patch. The slot is a radiating slot and produces a supplementary resonance along another resonance path. By appropriately choosing its shape and its dimensions, the slot produces required values of the frequencies of the resonances, which provides the facility to transmit a circularly polarized wave by associating two modes having the same frequency and crossed linear polarizations with a relative phase of 90°. The coupling device takes the form of a microstrip line which is also coplanar in that the microstrip is in the plane of the patch and penetrates between two notches of the patch. The device includes impedance converter means for matching it to the various input impedances respectively presented by the line at the various resonant frequencies used as operating frequencies.

This first prior art antenna has the following drawbacks, among others:

The necessity to provide impedance converter means complicates its production.

It is difficult to adjust the resonant frequencies accurately to required values.

A second prior art antenna is described in U.S. Pat. No. 4,692,769 (Gegan). In a first embodiment the patch of this antenna is in the form of a circular disk 10 and the antenna has two half-wave resonances. The coupling system takes the form of a line 16 constituting a quarter-wave transformer and connected to a point inside the area of the patch so as to impart substantially equal values to the real part of the input impedance of the antenna for the two resonances. The line 16 is a microstrip line. Two slots are formed in the conductive layer of the patch and penetrate into the area thereof from its periphery to delimit between them the strip of a terminal segment of the line. One of the two slots is continued by an extension that constitutes an impedance matching slot 28.

This second prior art antenna has the following drawbacks, among others:

It is difficult to produce the impedance converter means.

It is difficult to adjust the resonant frequencies accurately to required values.

A third prior art dual frequency antenna differs from the previous ones in that it uses a quarter-wave resonance. It is described in the following paper: IEEE ANTENNAS AND PROPAGATION SOCIETY INTERNATIONAL SYMPOSIUM DIGEST, NEWPORT BEACH, Jun. 18–23, 1995, pages 2124–2127 Boag et al "Dual Band Cavity-Backed Quarter-wave Patch Antenna". A first resonant frequency is defined by the dimensions and the characteristics of the substrate and the patch of the antenna. A matching system produces a resonance of substantially the same type at a second frequency on the same resonance path.

This third prior art antenna has the following drawbacks, among others:

The difference between the two resonant frequencies is too small in some applications.

The necessity to use a matching system complicates the production of the antenna.

The necessity to use a matching system complicates the production of the coupling device of the antenna in the form of a coaxial line.

The present invention has the following objects, among others:

a dual frequency antenna that is simple to manufacture, a freer choice than previously of the ratio of the center frequencies of the two operating bands of a transmitter device, and more particularly an antenna for the device such that the ratio of the two usable resonant frequencies of the antenna is from approximately 1.25:1 to approximately 5:1 and in particular around 2:1, a pass-band of the antenna that is sufficiently wide around each of these two resonant frequencies for one transmit frequency and one receive frequency of the device to be situated in each of the two bands, easy and accurate adjustment of the two resonant frequencies, use of a single coupling device for each of the two resonant frequencies, the impedance of which is easily adaptable, and limited antenna dimensions.

SUMMARY OF THE INVENTION

With the above objects in view, the present invention provides a planar antenna including superposed layers respectively constituting:

a conductive ground, a dielectric substrate formed on the ground, and a patch formed on the substrate, wherein the patch has an area and a periphery and includes a separator slot having an origin on the periphery and a closed end in the area, the closed end leaves a passage between itself and the periphery, the slot penetrates into the area from the origin and cooperates with the periphery to delimit in the area a first region and a second region, the two regions are conductive and electrically separated from each other by the slot and connected by the passage, the regions have respective areas, and the antenna further includes a reactive component mutually coupling the two conductive regions.

The reactive component is preferably flat, for example a surface mount component, which means that there is no significant projection from the planar structure of the antenna. For example, it is a capacitor having an area less than the area of each of the first and second regions, the area is less than the area of the patch and extends continuously over the first region, over the separator slot at a distance from the closed end and over the second region, and the capacitor is formed by the superposed layers cooperating with the patch and respectively constituting:

a dielectric layer formed on the patch, and a conductive armature formed on the dielectric layer.

A flat reactive component can nevertheless have a different shape to provide coupling in accordance with the present invention. For example, it can be an interdigitated capacitor integrated into the trace of the separator slot by appropriate cut-outs in the facing edges of the two regions of the patch.

The antenna preferably further includes a short circuit electrically connecting the first conductive region to the ground in the vicinity of the origin of the separator slot.

The area of the capacitor is preferably from 1% to 25% of the area of the patch.

Preferably, the origin of the separator slot is close to the short circuit so that the two resonances have respective resonance paths which both extend from the short circuit, one of the two paths extending only in the first region and the other one extending in the first and second regions.

Various aspects of the present invention will be better understood from the following description and the accompanying diagrammatic drawings. When components are shown in more than one figure of the drawings, they are designated therein by the same reference numbers and/or letters.

DETAILED DESCRIPTION OF THE PREFERRED EMBODIMENT

Figure 1:
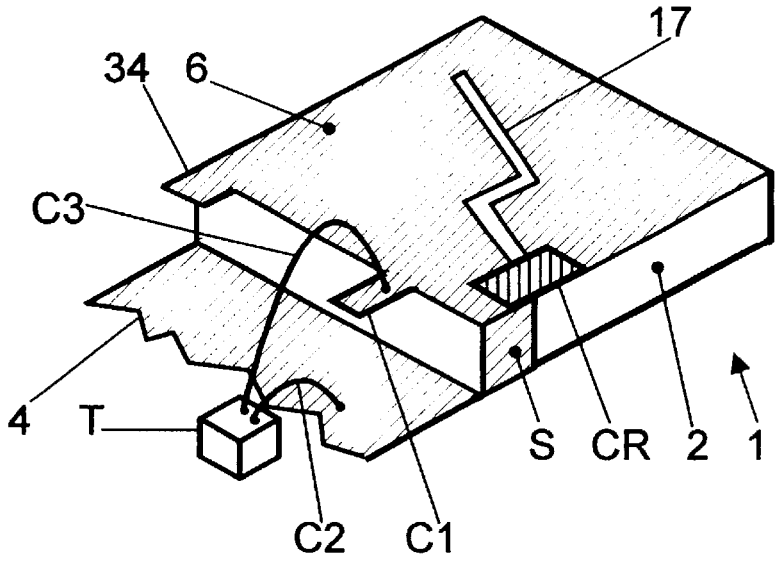
FIG. 1 is a perspective view of a transmission device in accordance with the present invention.
Figure 4:
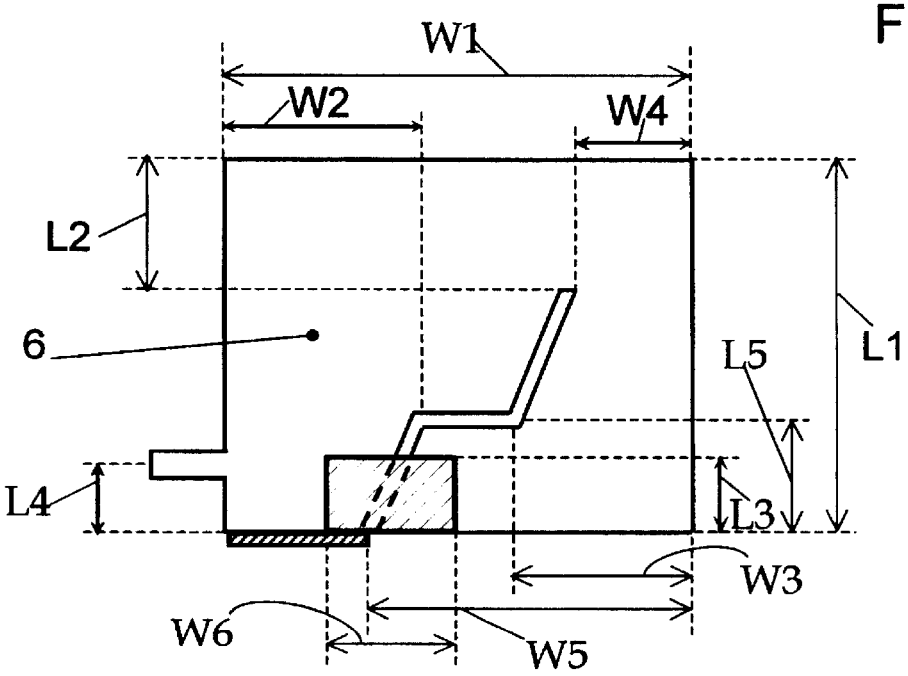
FIG. 4 reproduces the view of FIG. 2 for the purpose of designating various dimensions of the same antenna.
Figure 2:
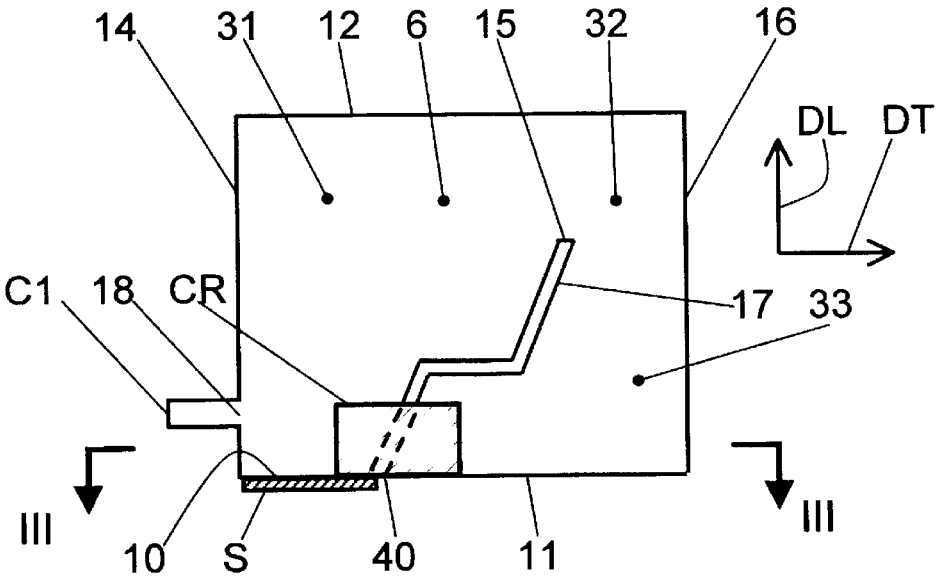
FIG. 2 is a plan view of an antenna in accordance with the present invention analogous to that of the device shown in FIG. 1.
Figure 3:
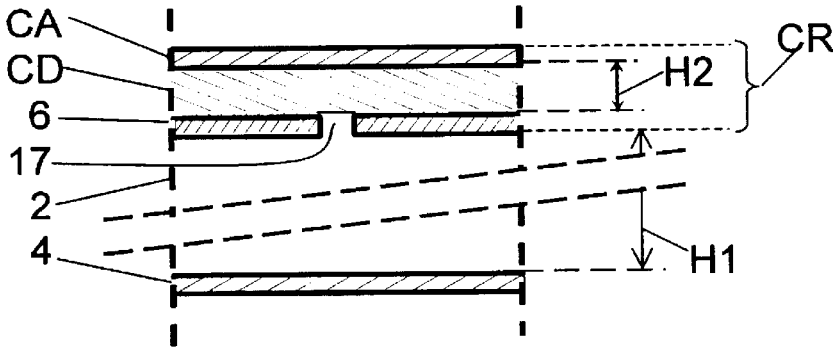
FIG. 3 is a partial view of the antenna from FIG. 2 in vertical section.

In a manner that is known in the art, and as shown in FIGS. 1 to 3, the resonant structure of an antenna according to the present invention includes the following components:

A dielectric substrate 2 having two opposite main surfaces extending in a horizontal longitudinal direction DL and a horizontal transverse direction DT. The substrate can be various shapes, as previously explained. Its two main surfaces respectively constitute a bottom surface and a top surface.

A bottom conductive layer extending over the whole of the bottom surface, for example, and constituting a ground 4 of the antenna.

A top conductive layer extending over an area of the top surface above the ground 4 to constitute a patch 6. As a general rule the patch has a length in the direction DL and a width in the direction DT and its periphery can be considered to consist of four edges. One of those edges extends generally in the direction DT and constitutes a rear edge including two segments 10 and 11. A front edge 12 is opposite this rear edge. First and second lateral edges 14 and 16 extend generally in the direction DL and join the rear edge to the front edge.

Finally, a short circuit electrically connecting the patch 6 to the ground 4 in the segment 10 of the rear edge of the patch. In the embodiment of the invention shown, this short circuit is formed by a conductive layer S extending over an edge surface of the substrate 2, which surface is typically plane, and then constitutes a short circuit plane. It imposes, at least approximately, and for at least one resonance of the antenna, an electric field node in the vicinity of the segment 10, and is therefore substantially of the quarter-wave type. The rear, front and lateral edges and the longitudinal and transverse directions are defined by the position of the short circuit if the short circuit is of sufficient magnitude, i.e. in particular if its impedance is sufficiently low to impose on the antenna a resonance having this kind of electric field node.

The antenna further includes a coupling system. The coupling system takes the form of a microstrip line. The line includes, on the one hand, a main conductor consisting of a coupling strip C1 on the top surface of the substrate. The strip is connected to the patch 6 at a connection point 18 that can be on the first lateral edge 14, for example. The distance from the rear edge 10 to this point constitutes a connection dimension L4. The line further includes a ground conductor consisting of the layer 4. In FIG. 1, and merely to simplify the drawing, the substrate 2 is not shown under the strip C1 and the line is shown as very short. The coupling system is part of a connection arrangement that connects the resonant structure of the antenna to a signal processor unit T, for example for exciting one or more resonances of the antenna by means of that unit in the case of a transmit antenna. In addition to the coupling system, the connection arrangement typically includes a connection line external to the antenna. The line can be a coaxial line, a microstrip line or a coplanar line, for example. In FIG. 1 it is shown symbolically as two conductive wires C2 and C3 respectively connecting the ground 4 and the strip C1 to the two terminals of the signal processor unit T. However, it must be understood that in practice the line would preferably take the form of a microstrip line or a coaxial line.

The signal processor unit T is adapted to operate at predetermined working frequencies that are at least close to the usable frequencies of the antenna, i.e. that are in passbands centered on those usable frequencies, which are those of at least some of the resonances of the antenna. It can be a composite unit, in which case it includes a respective device tuned permanently to each of the working frequencies. It can also include a device that can be tuned to the various working frequencies.

The separator slot 17 penetrates into the area of the patch 6 from an origin 40 separating two segments 10 and 11 of its rear edge. It extends as far as a closed end 15 situated at a distance from the lateral edges 14 and 16 and from the front edge 12. It partly separates from each other first and second regions 31 and 33 which are joined beyond the closed end by a passage 32. For example, it includes three rectilinear segments of similar length, a first segment extending from the origin 40 toward the front edge 12, approaching the second lateral edge 16, a second segment extending parallel to the front edge toward the lateral edge, and a third segment extending parallel to the first segment as far as the closed end 15. The distances from this closed end to these two edges are respectively less than half the length and half the width of the patch. A width of the slot is defined at each point along its length. It is uniform in this example, although this is not necessarily the case.

The presence of the slot produces two resonances respectively constituting a primary resonance having a primary resonant frequency and a secondary resonance having a secondary resonant frequency. The primary resonance extends over the whole of the patch 6. It is approximately of the quarter-wave type, its resonance path extending from the short circuit S to the segment 11 of the rear edge. It is mainly coupled with radiated waves from the segment 11 and the adjacent portion of the second lateral edge 16. The secondary resonance extends only over the region 31. It is also approximately of the quarter-wave type and its resonance path extends from the short circuit S to the front edge 12. It is mainly coupled with radiated waves from the front edge and the adjacent portion of the first lateral edge 14.

As shown only in FIG. 1, the first region 31 can have an excrescence 34 extending in the plane of the patch 6, projecting from the first lateral edge 14, in the vicinity of the front edge 12. It has been found that an excrescence of this kind can facilitate adjusting the resonant frequencies of the antenna.

In the context of the present invention, the antenna 1 further includes a reactive coupling component that is preferably flat and consists of a capacitor CR, for example. The capacitor has an area less than the area of each of the first and second regions 31 and 33, that area being less than the area of the patch 6 and extending continuously over the first region, over the separator slot 17 at a distance from the closed end 15, and over the second region. As shown in FIG. 3, it is formed of superposed layers cooperating with the patch 6 and respectively constituting:

a dielectric layer CD formed on the patch, and a conductive armature CA formed on the dielectric layer.

The capacitor is rectangular, for example, and its area is close to 5% of that of the patch. It is preferably in contact with or in the immediate vicinity of the periphery of the patch.

The reactive coupling component consisting of the capacitor CR creates a coupling between the first and second conductive regions 31 and 33, which has the following three advantages:

During manufacture of the antenna, it is easy to adjust the length and the width of the capacitor, which adjusts the coupling and thereby modifies the electrical parameters of the antenna.

The presence of the capacitor increases the electrical lengths of the antenna. In other words, it reduces the overall size of the antenna whilst retaining the required values of the resonant frequencies.

It widens the pass-bands of the two resonances without significantly increasing the standing wave ratios.

Various dispositions, compositions and values for the embodiment shown in FIG. 2 are indicated below by way of example:

The ground of the antenna covers the bottom face of the substrate.

The short circuit S occupies all of the width of the segment 10 that constitutes a rear edge of the first region 31.

Composition of the substrate 2: foam having a relative permittivity of 1.07 and a dissipation factor of 0.0002.

Thickness of substrate: H1=7 mm.

Composition of conductive layers: copper.

Thickness of conductive layers: 17 microns.

Width of conductor C1: 5 mm.

Connection dimension: L4=10 mm.

Length of patch: L1=35 mm.

Width of patch: W1=24 mm.

Width of segment 11: W5=16 mm.

Width of slot 17: 0.75 mm.

Trace of slot: L5=13 mm, W2=9 mm, W3=8 mm, L2=6 mm, W4=3 mm.

Relative permittivity of layer CD of capacitor CR: 2.2.

Thickness of layer CD: H2=0.1 mm.

Length of capacitor CR: L3=6 mm.

Width of capacitor CR: W6=7 mm.

Input impedance: 50 ohms.

Primary resonant frequency: F1=965 MHz.

Secondary resonant frequency: F2=1 860 MHz.

Width of pass-bands around primary and secondary frequencies: 9.1% and 19% of said frequencies, respectively, as measured at −6 dB.

Without the capacitor CR the resonant frequencies and the pass-band widths would respectively be: F1=1 120 MHz, F2=2 270 MHz, 16% and 10%.

There is claimed:

1. A planar antenna including superposed layers respectively constituting:

a conductive ground, a dielectric substrate formed on said ground, and a patch formed on said substrate, wherein said patch has an area and a periphery and includes a separator slot having an origin on said periphery and a closed end in said area, said closed end leaves a passage between itself and said periphery, said separator slot penetrates into said area from said origin and cooperates with said periphery to delimit in said area a first region and a second region that are conductive and electrically separated from each other by said separator slot and connected by said passage, said first region and said second region have respective areas, and said antenna further includes a reactive component forming a coupling between said two conductive regions, and overlaps said conductive ground.

2. The antenna claimed in claim 1 wherein said reactive component is a capacitor having an area less than the area of each of said first region and said second region, said area is less than said area of said patch and extends continuously over said first region, over said separator slot at a distance from said closed end and over said second region, and said capacitor is formed by said superposed layers cooperating with said patch and respectively constituting:

a dielectric layer formed on said patch, and a conductive armature formed on said dielectric layer.

3. The antenna claimed in claim 2 wherein said area of said capacitor is from 1% to 25% of said area of said patch.

4. The antenna claimed in claim 1 wherein said reactive component is in a vicinity of, and positioned adjacent to, said origin of said separator slot.

5. The antenna claimed in claim 4, further including a short circuit electrically connecting said first conductive region to said ground in the vicinity of said origin of said separator slot.

6. The antenna of claim 1, further comprising an excrescence extending in a plane of said patch and projecting from an edge of said periphery.

7. The antenna of claim 1, wherein an area of said reactive component is 5% of said area of said patch.

8. The antenna of claim 1, wherein a distance from said closed end to a front edge of said periphery of said patch is less than half of a length of said patch, and a distance from said closed end to a lateral edge of said periphery is less than half of a width of said patch.

9. The antenna of claim 1, wherein a primary resonant frequency in one of said first region and said second region is 965 MHz, and a secondary resonant frequency in the other of said first region and said second region is 1,860 MHz.

10. The antenna of claim 9, where a width of a pass-band around said primary resonant frequency is 9.1% of said primary resonant frequency, and a width of a pass-band around said secondary resonant frequency is 19% of said secondary resonant frequency.

11. A dual band transmitter device including:

a signal processor unit adapted to be tuned to a frequency in two working bands about two respective predetermined center frequencies for transmitting and/or receiving an electrical signal in each of said two working bands, a microstrip antenna including a patch and a ground, and an antenna connection arrangement including electrical conductors connecting said processor unit to said antenna to couple said electrical signal to radiated waves around each of said two center frequencies, wherein at least one of said electrical conductors are connected directly to said microstrip antenna, a separator slot at least partly isolates two conductive regions in said patch to impart to said antenna two resonances differing from each other in terms of the regions of said patch respectively occupied by said two resonances, said two resonances are centered in the respective two working bands, and said transmitter device further includes a reactive component external to said antenna connection arrangement and coupling said two conductive regions of said antenna and overlapping said ground.

12. A transmitter device according to claim 11, wherein said antenna includes superposed layers respectively constituting:

said ground, a dielectric substrate formed on said ground, and said patch formed on said substrate, said patch has an area and a periphery, said patch includes said separator slot, said slot has an origin on said periphery and a closed end in said area, said closed end leaves a passage between itself and said periphery, said slot penetrates into said area from said origin and cooperates with said periphery to delimit in said area a first of said regions and a second of said regions, said two regions are conductive and electrically separated from each other by said slot and connected by said passage, said regions have respective areas, said antenna further includes a short circuit formed in said first region on said periphery of said patch, said short circuit and said separator slot produce two resonances in said antenna, at least one of said two resonances is a quarter-wave resonance with an at least virtual electrical field node fixed by said short circuit, one of said two resonances constitutes a primary resonance and has a primary frequency substantially equal to one of said two center frequencies, the other of said two resonances constitutes a secondary resonance and has a secondary frequency substantially equal to the other of said two center frequencies, said connection arrangement couples said antenna to said signal processor unit about each of said two center frequencies, and said reactive component is a flat component substantially in the plane of said patch.

13. The transmission device claimed in claim 12 wherein said flat reactive component is a capacitor having an area less than the area of each of said first and second regions, said area is less than said area of said patch and extending continuously over said first region, over said separator slot at a distance from said closed end and over said second region, and said capacitor is formed by stacked layers cooperating with said patch and respectively constituting:

a dielectric layer formed on said patch, and a conductive armature formed on said dielectric layer.

14. The transmitter device claimed in claim 12 wherein said conductors included in said antenna connection arrangement and connected directly to said antenna include only:

a strip formed in the same conductive layer as said patch, and a ground formed in the same conductive layer as said ground of said antenna to constitute a microstrip line with said strip.

15. The device of claim 11, further comprising an excrescence extending in a plane of said patch and projecting from an edge of a periphery of said patch.

16. The device of claim 11, wherein an area of said reactive component is 5% of the area of said patch.

17. The device of claim 11, wherein a distance from a closed end of said separator slot to a front edge of a periphery of said patch is less than half of a length of said patch, and a distance from said closed end to a lateral edge of said periphery is less than half of a width of said patch.

18. The device of claim 11, wherein a primary resonant frequency in one of said regions is 965 MHz, and a secondary resonant frequency in the other of said regions is 1,860 MHz.

19. The device of claim 18, where a width of a pass-band around said primary resonant frequency is 9.1% of said primary resonant frequency, and a width of a pass-band around said secondary resonant frequency is 19% of said secondary resonant frequency.

* * * * *